US010791879B2

(12) United States Patent
Rosenbach

(10) Patent No.: US 10,791,879 B2
(45) Date of Patent: Oct. 6, 2020

(54) SHOWER DOOR TRACK

(71) Applicant: BCI Acrylic, Inc., Libertyville, IL (US)

(72) Inventor: Scott Rosenbach, Libertyville, IL (US)

(73) Assignee: BCI Acrylic, Inc., Libertyville, IL (US)

( * ) Notice: Subject to any disclaimer, the term of this patent is extended or adjusted under 35 U.S.C. 154(b) by 16 days.

(21) Appl. No.: 16/270,247

(22) Filed: Feb. 7, 2019

(65) Prior Publication Data

US 2019/0246847 A1 Aug. 15, 2019

Related U.S. Application Data

(60) Provisional application No. 62/630,902, filed on Feb. 15, 2018.

(51) Int. Cl.

| | |
|---|---|
| ***A47K 3/30*** | (2006.01) |
| ***A47K 3/34*** | (2006.01) |
| ***E05D 15/06*** | (2006.01) |

(52) U.S. Cl.

CPC ..... *A47K 3/302* (2013.01); *A47K 3/34* (2013.01); *E05D 15/0652* (2013.01); *E05D 15/0656* (2013.01); *E05D 15/0665* (2013.01); *A47K 2003/305* (2013.01); *E05Y 2800/12* (2013.01); *E05Y 2900/114* (2013.01)

(58) Field of Classification Search

CPC ..... A47K 3/34; A47K 3/302; E05D 15/0652; E05D 15/0656; E05D 15/0665

See application file for complete search history.

(56) References Cited

U.S. PATENT DOCUMENTS

| | | | | |
|---|---|---|---|---|
| 4,453,346 A * | 6/1984 | Powell | A47K 3/34 411/535 |
| 4,769,949 A * | 9/1988 | Glendowne | A47K 3/34 16/90 |
| 6,148,451 A * | 11/2000 | DeBraal | A47K 3/34 4/557 |
| 2017/0065133 A1* | 3/2017 | Whitaker | E05D 15/0656 |

* cited by examiner

*Primary Examiner* — Jeremy Carroll

(74) *Attorney, Agent, or Firm* — Knechtel, Demeur & Samlan

(57) ABSTRACT

A shower door track for mounting in a bathtub or shower. The shower door track is supported on the bathtub or shower and has a top surface to direct water into the tub. A channel extends the length of the track. A flexible elastomeric strip is mounted in the channel and bends when the user applies a horizontal force to the elastomeric strip to prevent injury or discomfort to the user.

8 Claims, 4 Drawing Sheets

SHOWER DOOR TRACK

CROSS-REFERENCE TO RELATED APPLICATIONS

This application is based on and claims priority of provisional patent application 62/630,902 filed Feb. 15, 2018.

BACKGROUND AND SUMMARY OF THE INVENTION

This invention relates to the field of shower doors that are used to enclose baths and showers. More specifically it relates to sliding shower doors and the guide that controls the movement of the shower door with respect to the track.

Shower doors are used to contain the water within a tub or shower from splashing into the bathroom. The water is contained into the shower or tub and goes down the drain. Thus, it is important that there is a good barrier between the shower door and the shower or tub so that the water is retained within the tub and does not seep out onto the bathroom floor.

Generally, the shower door has rollers or similar glides that are received in an upper track mounted above the top of the shower door. The shower door can thus slide along the upper track. There is also a lower track that is mounted on the top edge of the tub or shower. The lower track is a metal barrier that is mounted between the bottom of the sliding shower door and the top of the tub. The metal barrier has an upstanding lip that forms a barrier to keep water from passing between the bottom of the sliding door and the top of the tub. The barrier causes the water to be retained in the tub, rather than flowing out onto the bathroom floor. There is also a guide mounted on the lower track to control the movement of the shower door with respect to the lower track.

The problem with the prior systems is that the lower track is made from metal, generally aluminum or other non-rusting metal. The upper lip or barrier on the lower track is rigid throughout its construction. This rigid upstanding lip presents problems for the user. First, when a person is stepping into or out of the tub, if the person's leg and foot is not elevated enough to clear the top of the upstanding lip, the person can hit his or her foot or toes on the upstanding lip. As there is no "give" or flex in the upstanding lip, the user hurts himself or herself. In another instance, if the user is bathing small children in the tub, the user often is reaching into the tub and the person's chest engages the upstanding lip. This again causes the user undue discomfort as the upstanding lip is pushed into the user's chest.

Applicant's invention solves this problem of the discomfort and pain that a user may suffer when contacting the rigid upstanding lip of the lower track. Applicant has modified the lower track so that the upstanding portion of the track is flexible and will flex when a force is applied. Thus, if the user's foot hits the upstanding lip, the lip flexes and the user is spared the pain that would have resulted from the prior art design. Similarly, if the user bends over to reach into the tub, with the chest leaning against the upstanding lip, the lip will flex, and the user is again spared the discomfort that would have resulted to the user's chest when engaging a rigid upstanding lip of the previous design.

DESCRIPTION OF THE PREFERRED EMBODIMENT

Figure 1:
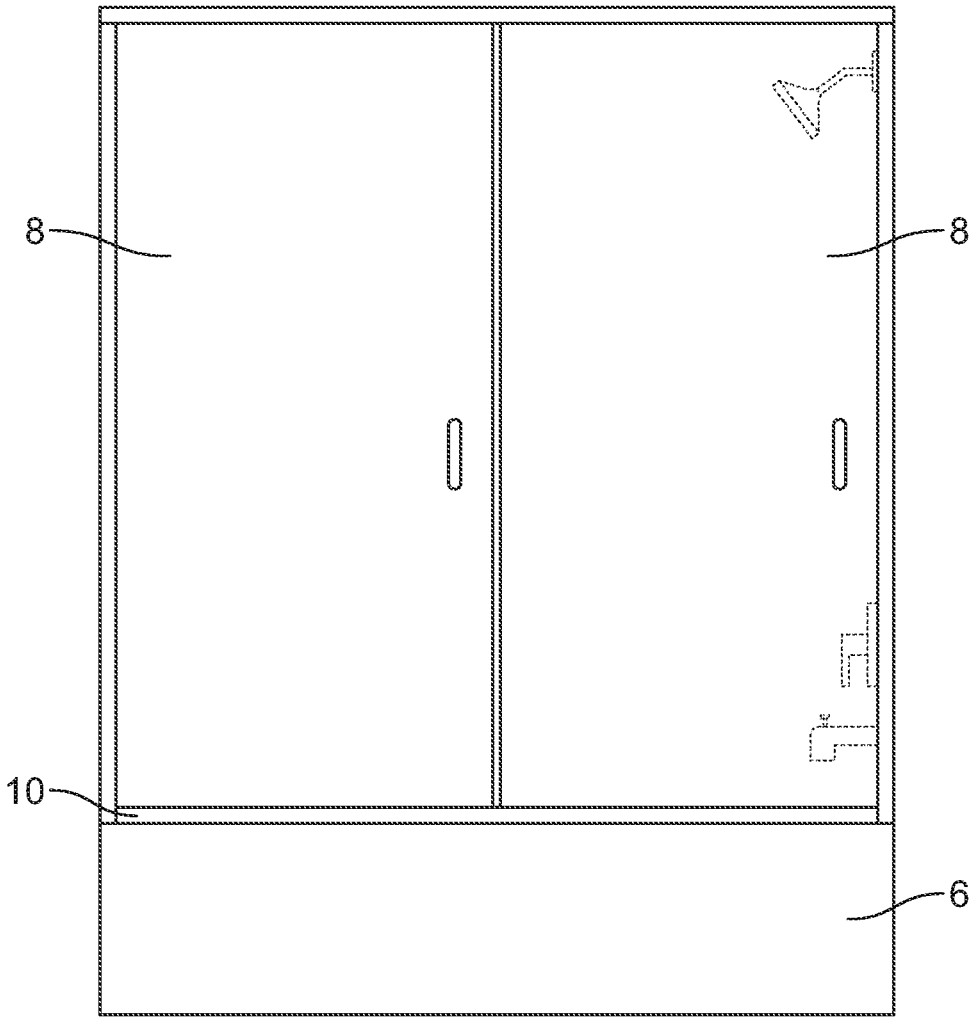
FIG. 1 is front view of a shower/bathtub illustrating the environment where the inventive shower door track is used.

Turning first to FIG. 1, there is illustrated a bathtub or shower 6 having one or more sliding or hinged shower doors 8. A shower door track 10 is mounted on the top edge of the bathtub or shower 6. The shower track 10 is generally made of a non-rusting material, such as aluminum. The shower track 10 can be affixed to the top of the tub by means of an adhesive, caulk, or other commonly used means so that the track 10 is secured to the top edge of the tub and is watertight with respect restraining water from flowing out from the tub, under the track 10 and out onto the floor. The track 10 has a forward support 12 and a rear support 14 that rest on the top of the top edge when the track 10 is installed. There is a top surface 13 that is integral with a forward sloping base 15 that directs water hitting the top surface 13 back into the tub. The forward support 12 and rear support 14 keep the track 10 above the top edge of the tub.

Figure 2:
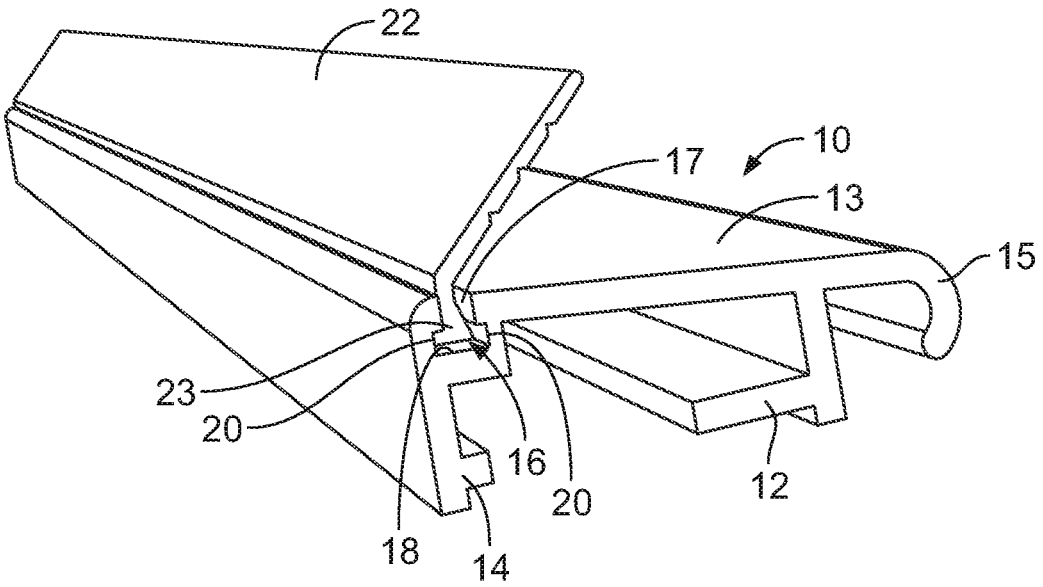
FIG. 2 is a front perspective view looking towards the end of the shower track.
Figure 3:
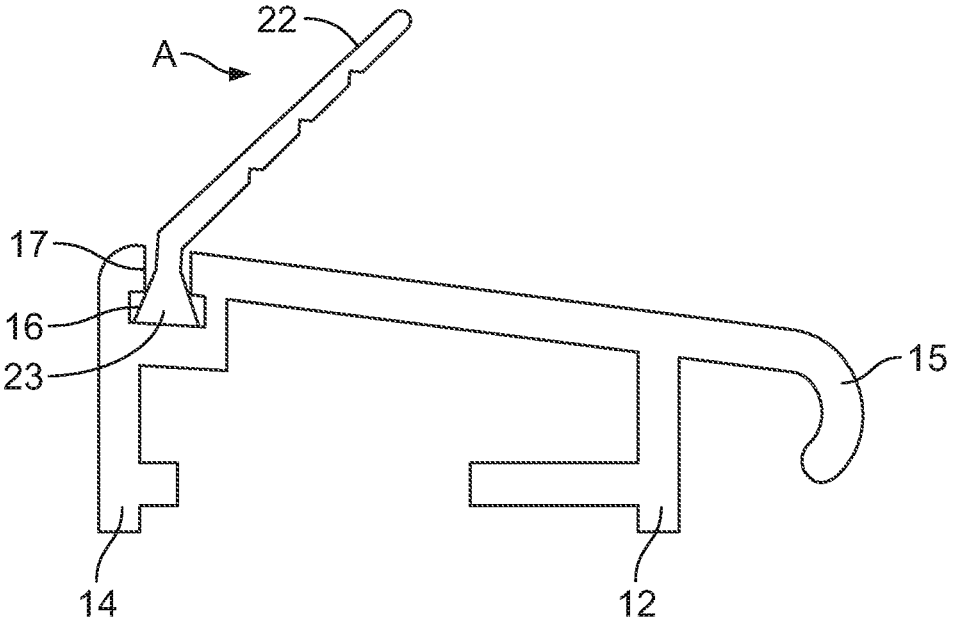
FIG. 3 is an end view of the shower track.

Above the rear support 14 is a channel 16 having a bottom 18 and opposite sidewalls 20. These define the channel 16. The sidewalls 20 can either be substantially flat or may have a small protruding shelf or finger extending from and running the length of the sidewalls 20. A slot 17 is formed in the top surface 13 between the top surface 13 and the top of the rear support 14. The slot 17 provides the entrance to the channel 16. The channel 16 and slot 17 receive a rubber or flexible strip 22 as illustrated in FIGS. 2 and 3. The rubber strip 22 can be any flexible elastomeric material that serves the purpose for which it is intended as described herein. The term rubber strip 22 is meant to include all such variations and materials. When manufactured the rubber strip 22 is slid into the channel 16 from one end of the channel 16 to the other end. The rubber strip 22 can have an enlarged foot 23 that is received in the channel 16. The rubber strip 22 should be secured into the channel 16 so that once installed, it cannot be easily removed. The width of the slot 17 is less than the thickness of the enlarged foot 23 so that it keeps the enlarged foot 23 from being pulled out of the channel 16. Alternatively, an adhesive can be used to secure the rubber strip 22 into the channel 16. As another alternative, the sidewalls 20 can be provided with a protruding shelf that will pinch the rubber strip 22 between the shelf and the opposite sidewall to securely hold the rubber strip 22 in place.

Figure 4:
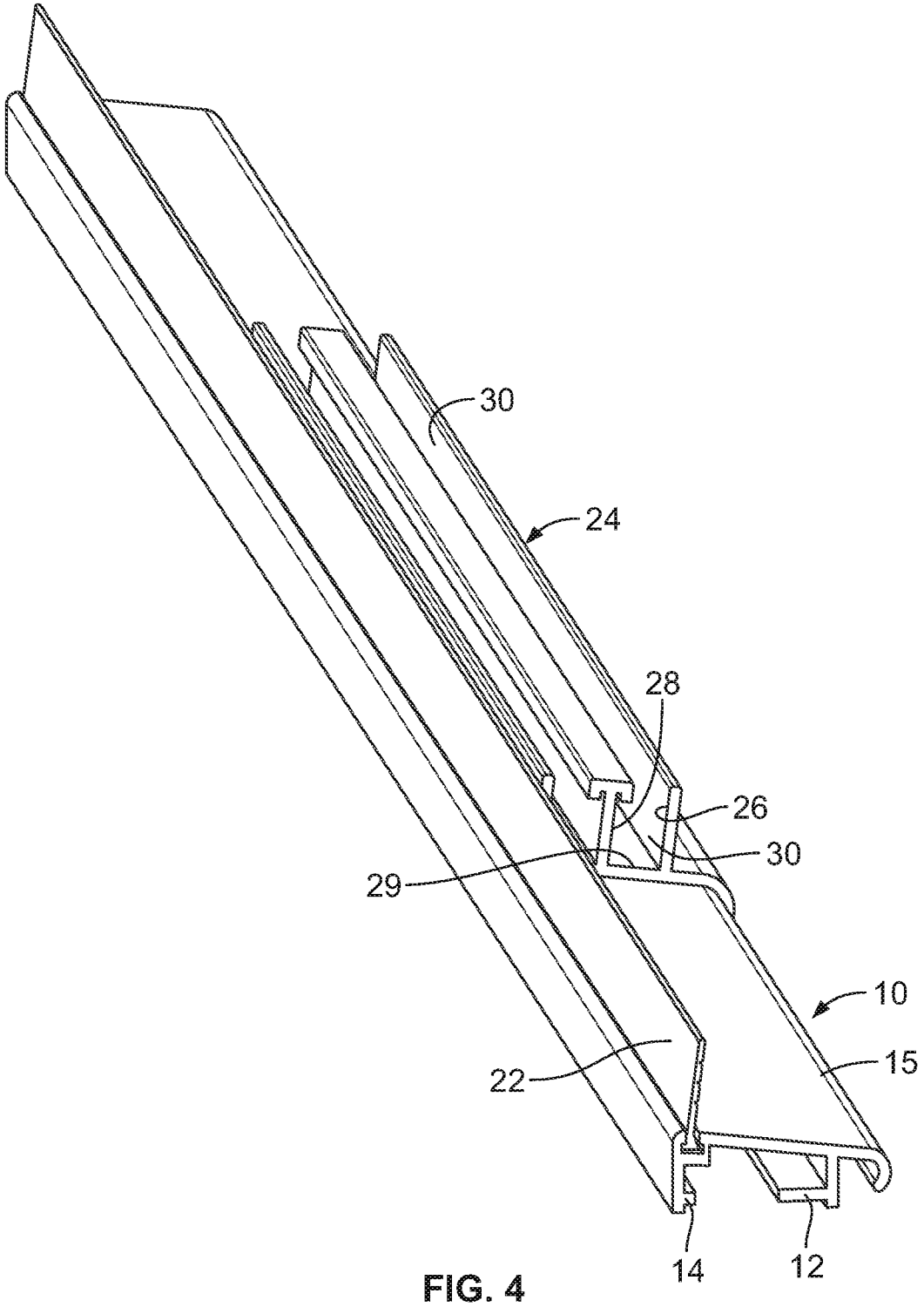
FIG. 4 is a front perspective view of the shower track with the shower door guide positioned on the shower track.

There is a shower door guide 24 as seen in FIG. 4. The door guide 24 can be screwed into the top surface 13 or it can be secured by adhesive or caulk or affixed in other conventional manners so that it is secured to the top surface 13. The door guide 24 has a front wall 26, a rear guide wall 28 and a base 29. These form a channel 30 that receives the bottom of the shower doors 8 and maintains the shower doors in place as they slide back and forth allowing the user to enter and leave the tub.

Figure 5:
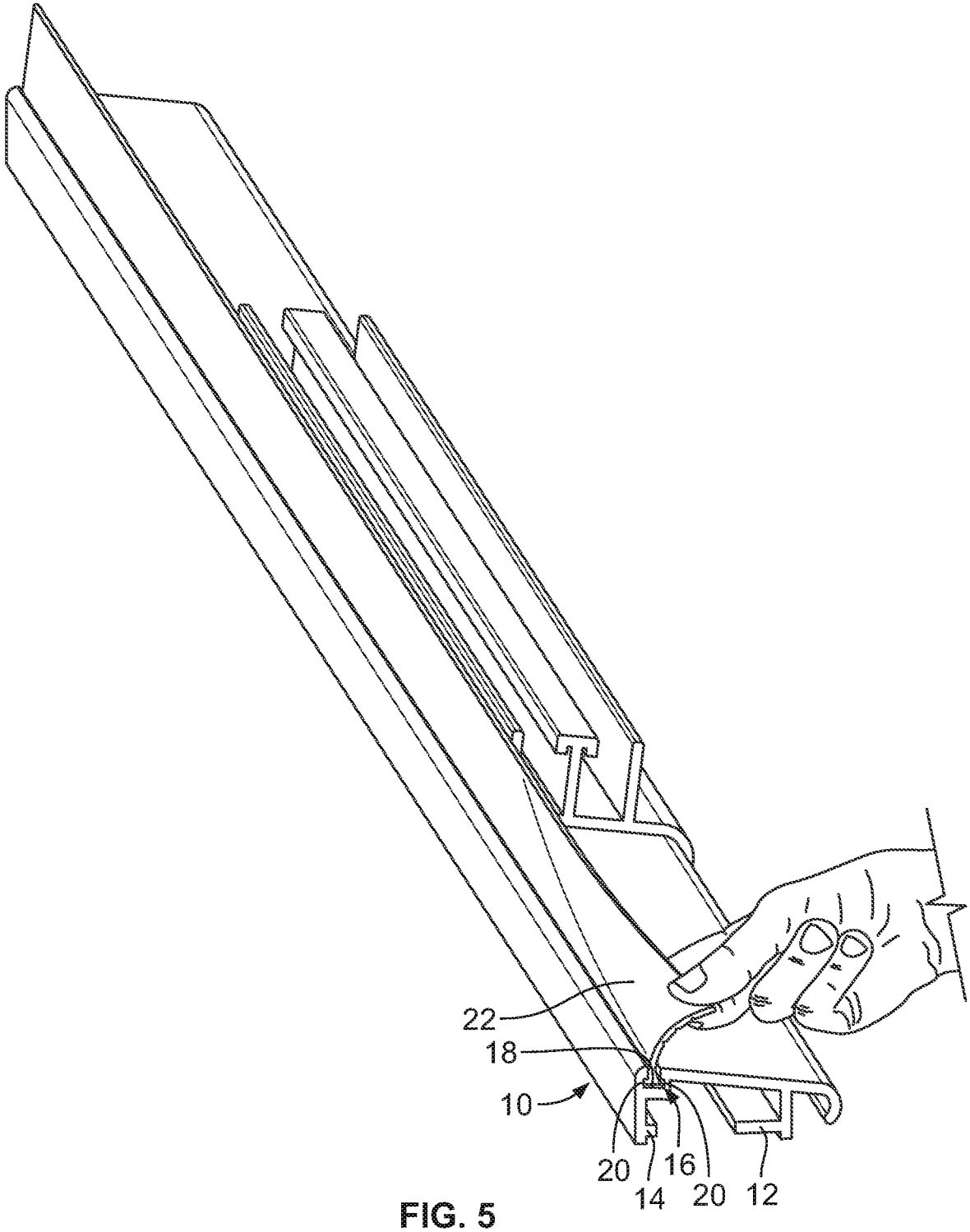
FIG. 5 is a perspective view of the shower track showing the upstanding lip being bent when a force is applied to it.

As can be seen from FIGS. 3 and 5, when the user contacts the upstanding rubber strip 22, a force in the direction "A" causes the strip 22 to flex and bend, thus minimizing the force that the user experiences on his or her foot or chest. This results in minimal pain to the foot or other body part contacting the upstanding strip 22. The strip 22 will bend to substantially a flat horizontal position and the point where it bends with respect to the top surface 13 will only result in the flexible strip having a height above the top surface 13 of approximately one-eighth inch, which makes it compliant with the American Disabilities Act.

Thus, there has been provided a shower door track that fully satisfies the objects set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A shower door track for mounting in a bathtub or shower comprising:

a base having a length and a width supported by at least one elevating supporting member, the base having a top and a front surface to direct water into the tub, a channel within the base and extending the length of the base, a slot having a width in the top of the base, the slot in communication with the channel for providing an entrance to the channel, a vertically oriented flexible elastomeric strip mounted in the channel, the elastomeric strip having a height, with a top end extending above the base and a bottom end being in the channel, the bottom end of the elastomeric strip having an enlarged portion greater than the width of the slot to retain the elastomeric strip in the channel, the elastomeric strip extending upward from the channel and through the top of the base for restraining water from leaving the tub.

2. The shower door track of claim 1 and further comprising a shower door guide mounted on the top of the base for receiving the shower door, whereby the shower door can slide horizontally within the guide.

3. The shower door track of claim 2 wherein the base is secured to the top of a tub in watertight fashion.

4. The shower door track of claim 1 wherein the channel has a channel width greater than the width of the slot.

5. The shower door track of claim 4 and further comprising a curved front edge at a leading edge of the base.

6. The shower door track of claim 1 and further comprising at least a second elevating supporting member.

7. The shower track door of claim 1 wherein the elastomeric strip bends from its vertically oriented position to a substantially flat horizontal position above the base when a force perpendicular to the vertically oriented elastomeric strip is applied to the elastomeric strip.

8. The shower track of claim 1 wherein the elastomeric strip extends one-eighth inch above the base when the force perpendicular to the vertically oriented elastomeric strip is applied to the elastomeric strip.

* * * * *